US005193459A

United States Patent [19]

Barbour

[11] Patent Number: 5,193,459

[45] Date of Patent: Mar. 16, 1993

[54] IMPRINTER APPARATUS AND METHOD

[75] Inventor: William P. Barbour, Huddleston, Va.

[73] Assignee: DataCard Corporation, Minnetonka, Minn.

[21] Appl. No.: 803,335

[22] Filed: Dec. 4, 1991

[51] Int. Cl.[5] ..... B41F 3/04

[52] U.S. Cl. ..... 101/269; 101/56

[58] Field of Search ..... 101/269–274, 101/56

[56] References Cited

U.S. PATENT DOCUMENTS

| | | | |
|---|---|---|---|
| 3,260,199 | 7/1966 | Huntley et al. | 101/269 |
| 3,538,848 | 11/1970 | Barbour | 101/267 |
| 3,739,716 | 6/1973 | Barbour | 101/45 |
| 3,810,424 | 5/1974 | Barbour | 101/269 |
| 3,954,056 | 5/1976 | Barbour | 101/269 |
| 4,938,132 | 7/1990 | Finn et al. | 101/269 |
| 5,062,361 | 11/1991 | Kabelsky | 101/269 |

FOREIGN PATENT DOCUMENTS

| | | |
|---|---|---|
| 52312/73 | 8/1974 | Australia . |
| 948478 | 6/1974 | Canada . |
| 1352294 | 5/1974 | United Kingdom . |

*Primary Examiner*—Edgar S. Burr
*Assistant Examiner*—Lynn D. Hendrickson
*Attorney, Agent, or Firm*—Merchant, Gould, Smith, Edell, Welter & Schmidt

[57] ABSTRACT

An imprinter apparatus which utilizes a print roller traveling within a carraige over a base plate is provided with a rolling assembly which engages channels in the base plate to minimize play between the carriage and the base plate. The rolling assembly includes a first set of rollers which are laterally constrained within the carriage, a second set of rollers which are free to move laterally, and means for retaining the rollers in the channels. The imprinter apparatus is further provided with means for selectively lifting and lowering the print roller at the end and beginning of the print stroke. The lifting and lowering means includes inclined planar regions on a plastic molded print roller axle and cam means for laterally sliding the location of support of the axle along the inclined planar surface to selectively lift and lower the print roller.

16 Claims, 5 Drawing Sheets

IMPRINTER APPARATUS AND METHOD

BACKGROUND OF THE INVENTION

1. Field of the Invention

The present invention relates to a data recorder for imprinting information from a source member such as a credit card on a recording document such as a credit card transaction form. More specifically, it relates to an imprinter apparatus which utilizes a print roller traveling within a carriage over a base plate or flat bed. In such an apparatus, an imprint is made by moving the carriage and print roller over the source member and recording document in a print stroke, lifting the print roller, and moving the carriage back with a return stroke.

2. Description of the Prior Art

Imprinter products such as credit card imprinters are quite cost sensitive, and accordingly, it is desirable to keep assembly time down and to use ultra low cost components in the construction of these devices. Because of cost concerns, ultra-precise tolerances cannot be maintained in parts which are meant to work together.

One of the more time-consuming tasks in assembling existing flat bed credit card imprinters centers around the steps required to remove any play between the print carriage and the base plate on which it travels.

The usual method of fitting the print carriage to the base plate involves placing thin metal or plastic spacing washers between the print carriage wheels and the walls which project downward from the metal bed of the carriage. This method is very time consuming, and hence, costly.

Another shortcoming of presently available flat bed credit card imprinters is in the use of metal axles to carry plastic print rollers. When an imprinting stroke is made, the metal axle is acted upon in a variety of ways to cause raising and lowering of the print roller. One means for raising and lowering the print roller makes use of an inclined surface in which the metal axle is in contact with metal adjusting means. It is preferable to produce axles with flat contact surfaces; however, flat surfaces are difficult to produce in such axles, leading to metal print roller axles being typically manufactured using a turning operation to produce the inclined surfaces. The use of turned axles will result in the adjusting means contacting the axle in a line contact. The constant sliding of a metal axle against metal adjusting means also typically necessitates that these members be hardened and lubricated in order to prevent extreme wear and thus negatively affect the imprint quality. Furthermore, such a turning operation produces an area which is weakened, and which is prone to distortion during the hardening process.

This set of circumstances results in parts which are expensive to manufacture, which have limited lifetimes, and which are noisy in use since hardened metal parts are in dynamic contact with each other.

The present invention solves these and other problems associated with existing flat bed credit card imprinters.

SUMMARY OF THE INVENTION

It is an object of the present invention to provide means for attaching a print carriage to a base plate such that the print carriage can be adjusted to fit the base plate in a simple, straightforward manner. In particular, the present invention provides a rolling assembly including rollers which are laterally fixed as well as rollers which are laterally free to move. Riding in channels, the rollers act to fasten the print carriage to the base plate such that the carriage can travel in a linear direction. This rolling assembly acts to prevent unwanted motion in vertical and rotational directions, as well as in undesired horizontal directions.

The rolling assembly includes rollers for allowing the carriage to move in a linear direction, means for rotatably mounting the rollers to a first inner side surface of the carriage such that the rollers are laterally constrained, means for rotatably mounting additional rollers to a second inner side surface of the carriage such that the additional rollers are free to move laterally, a channel on the base plate by which the rollers are constrained, and means for holding the rollers in the channel. Preferably, all elements are made of inexpensive components which can be easily assembled.

Another object of the present invention is to provide a print roller axle for supporting a print roller in which the print roller axle is less costly to manufacture, is less susceptible to wear, and operates more quietly than that of the prior art. A preferred embodiment of the invention includes a molded print roller axle containing features which are economically unobtainable in a machined metal part.

Incorporated into the print roller axle is a geometry which allows for lifting and lowering of the print roller, prevents rotation of the axle, and which facilitates solid downward support during an imprint stroke. The molded print roller axle is inexpensive to manufacture and is not susceptible to wear.

These and various other advantages and features of novelty which characterize the present invention are pointed out with particularity in the claims annexed hereto and forming a part hereof. However, for a better understanding of the invention, its advantages and objects attained by its use, attention should be given to the drawings which form a further part hereof and to the accompanying descriptive matter in which there is illustrated and described a preferred embodiment of the invention.

BRIEF DESCRIPTION OF THE DRAWINGS

Referring now to the FIGURES in which like reference numerals represent corresponding parts throughout the several views.

DETAILED DESCRIPTION OF THE PREFERRED EMBODIMENT

In the following detailed description of the preferred embodiment, reference is made to the accompanying drawings which form a part hereof and wherein like numerals refer to like parts throughout, and in which is shown by way of illustration a specific embodiment in which the invention may be practiced. It is to be understood that other embodiments may be utilized without departing from the scope of the present invention.

Figure 1:
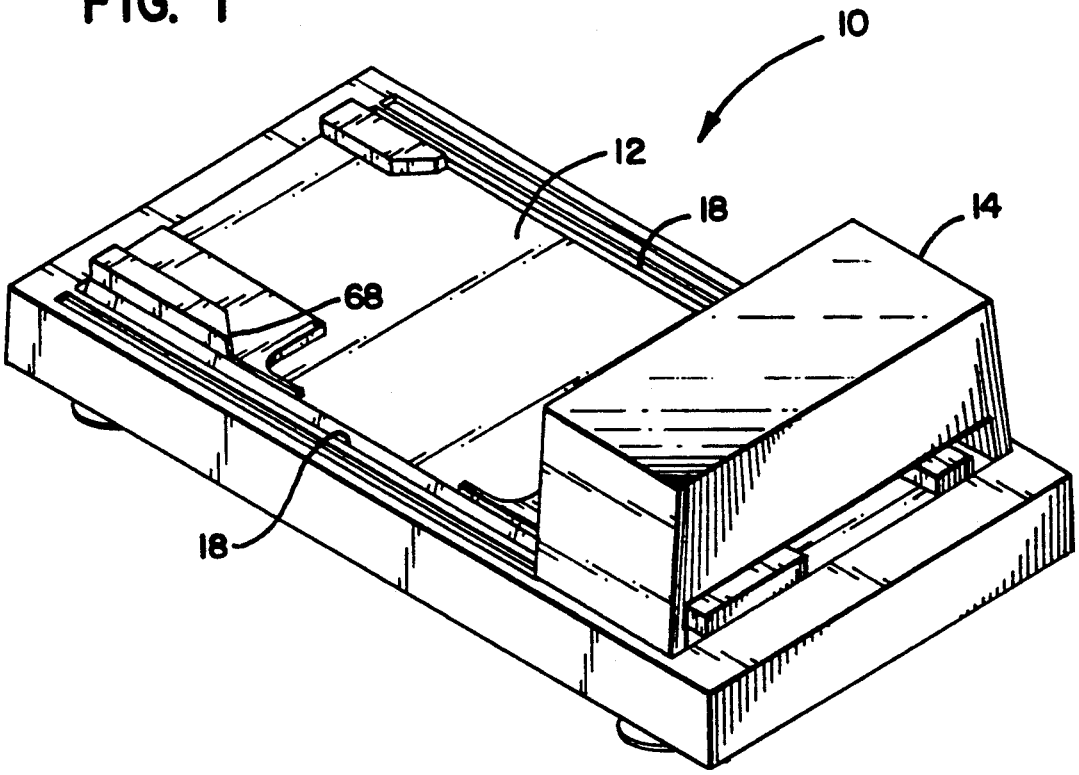
FIG. 1 is a perspective view of one embodiment of an imprinter apparatus in accordance with the present invention.

Shown in FIG. 1 is an embodiment of an imprinter apparatus 10 in accordance with the principles of the present invention and which is used for recording credit card data on a credit sales transaction form. The imprinter apparatus 10 includes a base plate 12 over which travels a printer carriage 14. In the preferred embodiment of the apparatus 10, the printer carriage 14 is provided with a first roller assembly 15 and a second roller assembly 16, the combination of which attaches the printer carriage 14 to the base plate 12 and guides the printer carriage 14 along the length of the base plate 12. The base plate 12 may be made of any suitable material such as extruded aluminum. The top surface of base plate 12 is provided with two parallel channels 18 which extend along the length of the base plate 12. The channels 18 interact with the first and second roller assemblies 15, 16 in the printer carriage 14 to constrain the roller assemblies 15, 16, and thereby the printer carriage 14, from unnecessary side movement relative to the base plate. The manner in which this is accomplished is hereinafter described.

Figure 2:
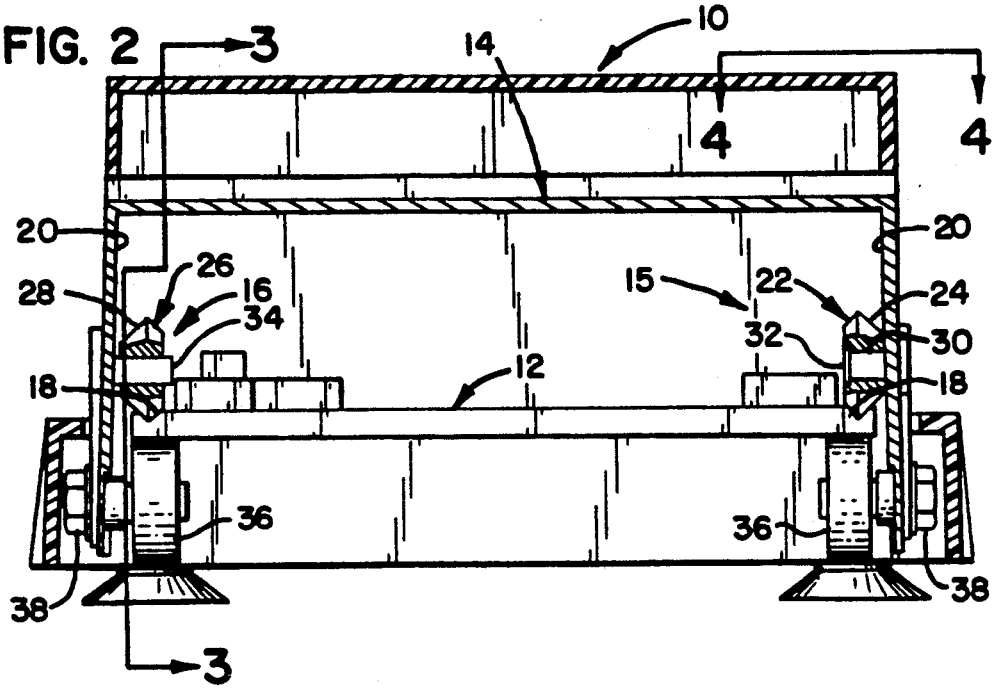
FIG. 2 is a front elevational view in cross-section of the print carriage and base plate of the imprinter apparatus shown in FIG. 1.

Referring now to FIG. 2, there is shown a cross-sectional view of the print carriage 14 and base plate 12 of the preferred embodiment. The base plate 12 is shown to include two parallel channels 18, each of which is situated proximate a top edge of the base plate 12. Each of the parallel channels is formed having a V-shaped cross-sectional profile. The printer carriage 14 includes first and second roller assemblies 15, 16, each of which interacts respectively with one of the V-shaped channels 18.

First roller assembly 15 includes two rollers 22 which are positioned along an inner side surface 20 of the print carriage 14. The circumferential edges 24 of the rollers 22 have a V configuration conforming to the V-shaped profile of the channels 18 in the base plate 12. These rollers 22 are rotatably fixed against the inner side surface 20 of the print carriage 14 by roller pins 30, the heads 32 of which are flanged to prevent lateral movement of the rollers 22 along their respective pins 30 and to hold the rollers 22 snugly against the inner surface 20 of the print carriage 14.

Second roller assembly 16 includes two rollers 26 which are mounted along the opposite inner side surface 20 of the print carriage 14. The circumferential edges 28 of the rollers 26 also have a V configuration conforming to the V-shaped profile of the channels 18 in the base plate 12. The rollers 26 are rotatably mounted on roller pins 34 along which they are allowed to slide laterally. Because the second set of rollers 26 are free to slide along their pins 34, variations in the width between the channels 18 do not adversely influence the operation of the imprinter apparatus 10.

Figure 4:
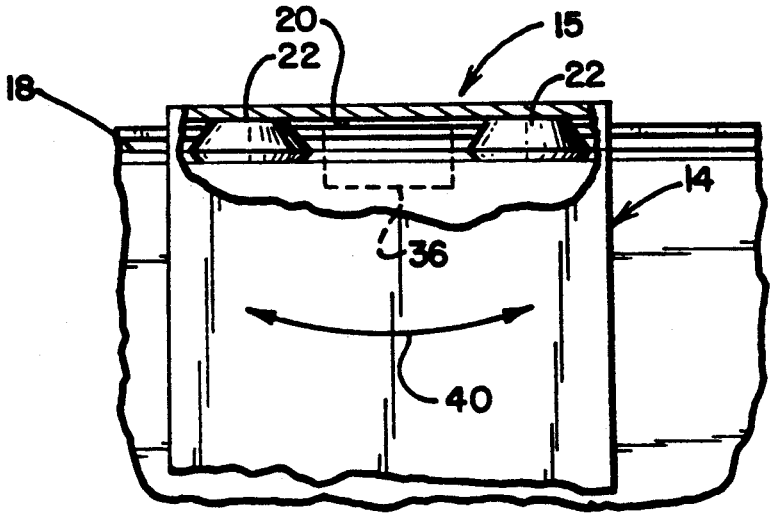
FIG. 4 is a top view in partial cross-section of a portion of the print carriage and base plate of the imprinter apparatus taken generally along lines 4—4 of FIG. 2.
Figure 3:
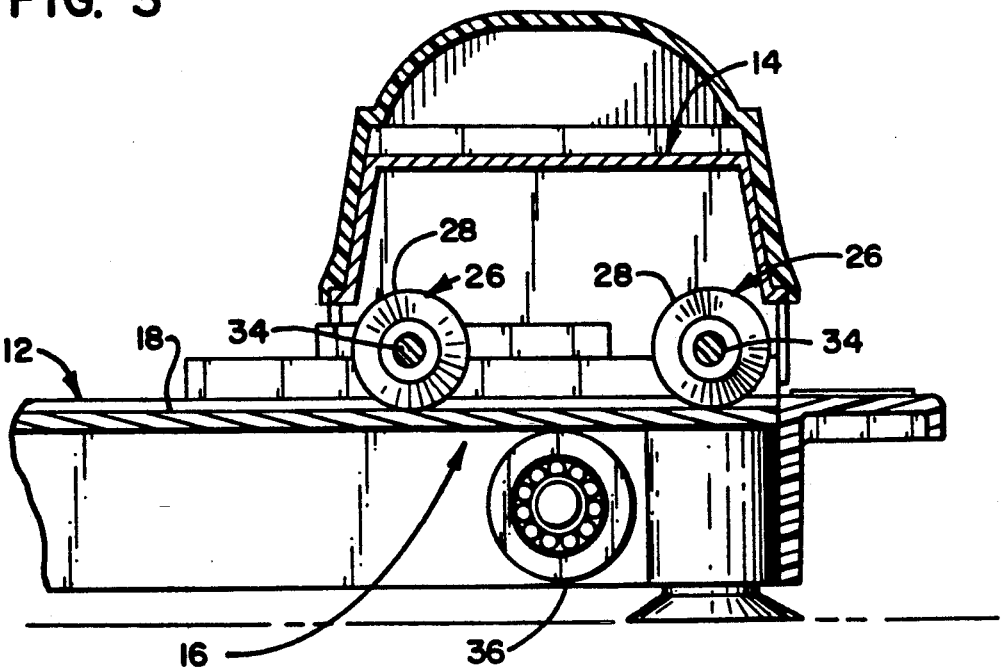
FIG. 3 is a side elevational view in cross-section of the print carriage and base plate of the imprinter apparatus taken generally along lines 3—3 of FIG. 2.

As may be seen in FIGS. 2 and 3, pressure rollers 36 are brought up to bear snugly against the underside of the base plate 12, and are fastened by attachment means 38 to the inner side surface 20 of the printer carriage 14 below each set of rollers 22, 26. The pressure rollers 36 act to prevent the rollers 22, 26 from leaving the V-shaped channels 18 and eliminate any unwanted vertical motion of the roller assemblies 15, 16. Further, by retaining the fixed rollers 22 in the channels 18, the pressure rollers 36, in combination with the fixed rollers 22, prevent unwanted rotation of the print carriage 14 with respect to the base plate 12 in a plane symbolized by the arrow 40 as illustrated in FIG. 4.

In addition to the elements described above, the printer carriage 14 of the present invention is provided with means for raising and lowering a print roller 50 at predetermined intervals while performing an imprint stroke.

Figure 5:
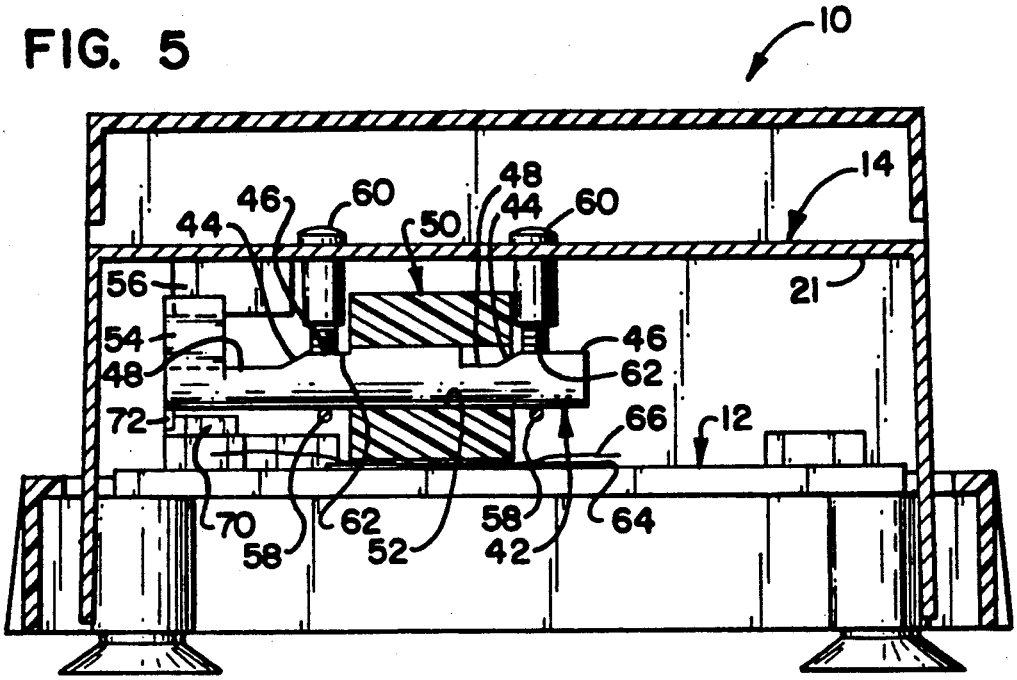
FIG. 5 is a front elevational view in cross-section of the print carriage and base plate of the apparatus shown in FIG. 1, including a molded print roller axle with a print roller in a lowered state.

Referring to FIG. 5, a printer carriage 14 is shown to include a print roller 50 made of a suitable plastic material. The print roller 50 is provided with an axial bore 52 of sufficient diameter to allow free rotation about a molded print roller axle 42. The print roller axle 42 is molded out of nylon or another suitable plastic material.

Figure 7:
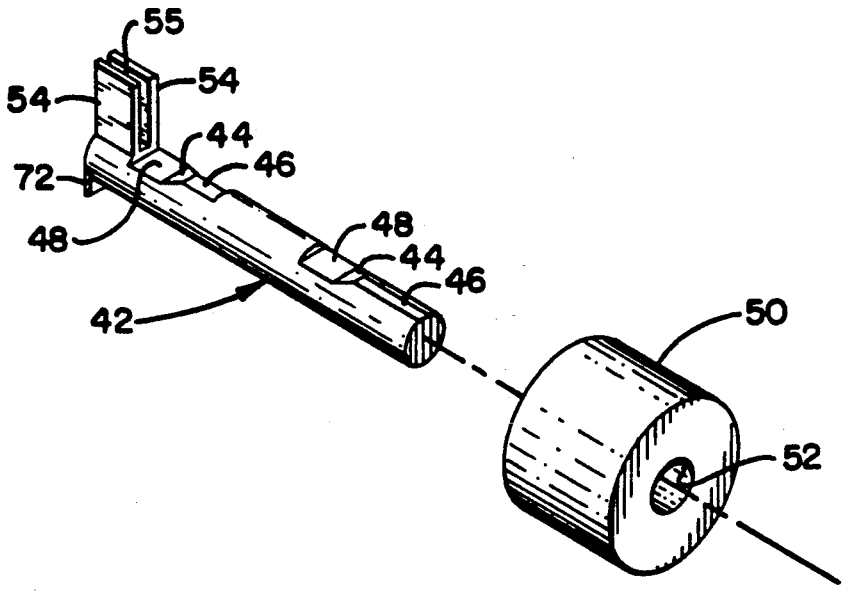
FIG. 7 is an exploded perspective view of a molded print roller axle with a print roller of the imprinter apparatus shown in FIG. 1.

As best seen in FIG. 7, the print roller axle 42 is molded to include planar or flat surfaces which are formed in alignment along the length of the axle 42. These flat surfaces are comprised of inclined ramps 44, upper bearing surfaces 46, and lower bearing surfaces 48. The print roller axle 42 is also provided at one end with integral flanges 54 which form a slot 55. Projecting from beneath the flanges 54 at the same end of the print roller axle 42 is a cam follower 72. The purpose of these elements will become evident in the following description.

Figure 8:
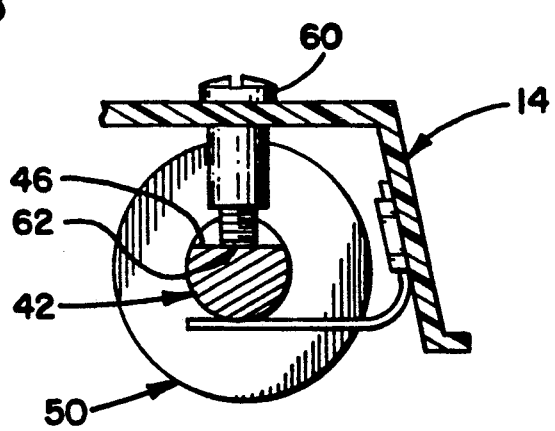
FIG. 8 is an elevational view in cross-section of a portion of the print carriage of the imprinter apparatus taken generally along lines 8—8 of FIG. 6.

Referring again to FIG. 5, adjusting screws 60 are threaded through the inner top surface 21 of the printer carriage 14. The screws 60 are formed with flat ends 62 which contact and bear down against the flat bearing surfaces 46, 48 of the print roller axle 42 to provide solid downward support during an imprint stroke. The print roller axle 42 is biased upward against the ends 62 of the screws 60 by biasing means 58. As shown in FIG. 8, the biasing means 58 of the preferred embodiment is a resilient wire or strip fixed at one end to the inner side surface 20 of the printer carriage 14, with the other end of the biasing means 58 bearing upwardly against the underside of the print roller axle 42.

The slot 55 formed by the flanges 54 molded at one end of the print roller axle 42 engages a downwardly projecting fin 56 that is formed in the inner top surface 21 of the printer carriage 14. The union of the fin 56 with the slot 55 prevents the print roller axle 42 from rotating during operation of the imprinter apparatus 10.

Figure 9:
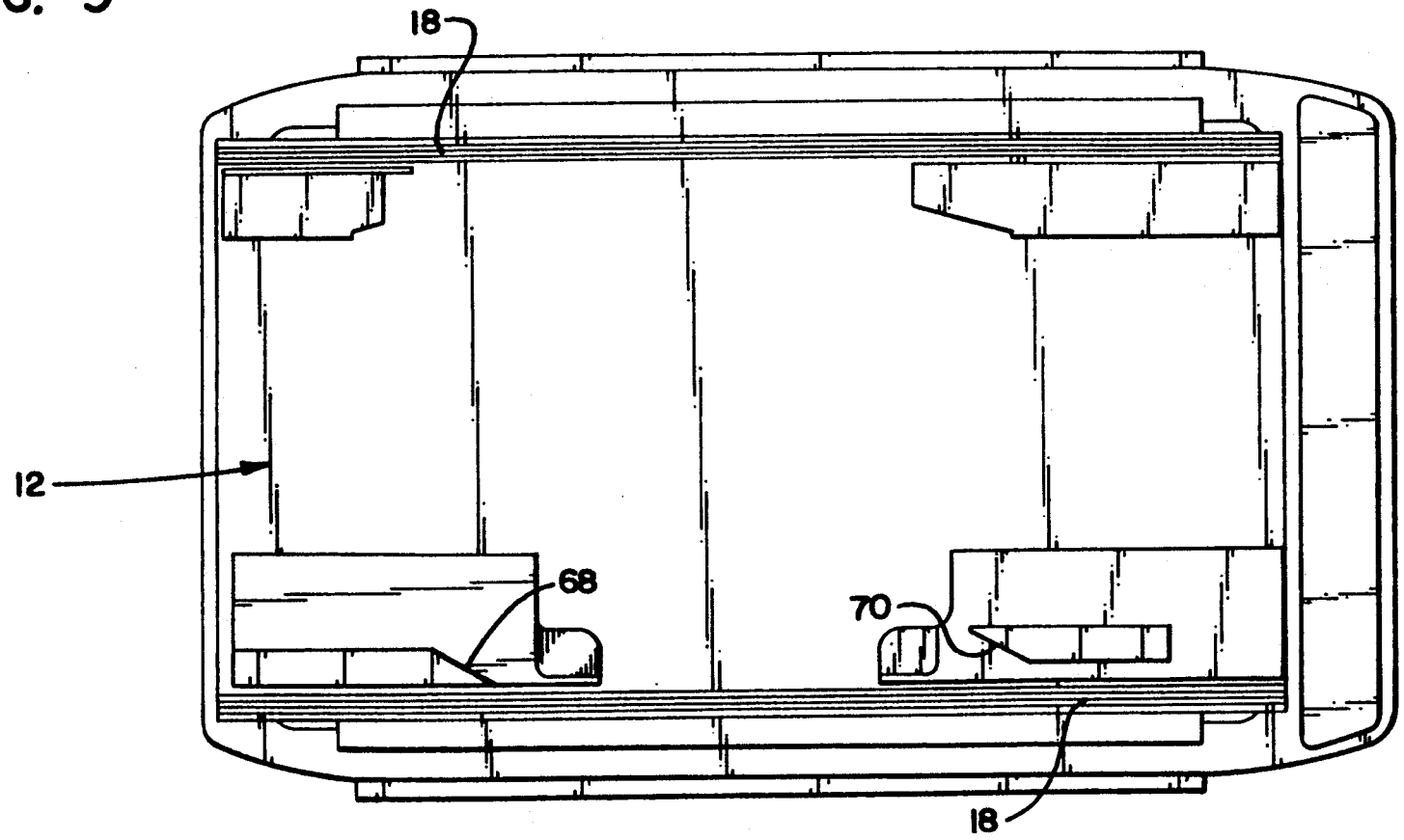
FIG. 9 is a top elevational view of the base plate of the imprinter apparatus shown in FIG. 1.

As illustrated in FIG. 9, a first cam surface 68 and a second cam surface 70 are shown projecting from the top surface of base plate 12. The purpose of these cam surfaces 68, 70 will be best understood in the context of the operation of the apparatus as described hereinafter.

The print roller 50 in FIG. 5 is in a lowered position for recording credit card data onto credit sales transaction form 66 which is situated between the print roller 50 and a credit card 64. The upper bearing surfaces 46 of the print roller axle 42 are in contact with the ends 62 of the adjusting screws 60 for solid downward support of the print roller 50 against the form 66 throughout the imprinting stroke. The screws 60 may be manually advanced or withdrawn to set the proper downward force for obtaining a clear impression of the credit card data on the transaction form 66.

Figure 6:
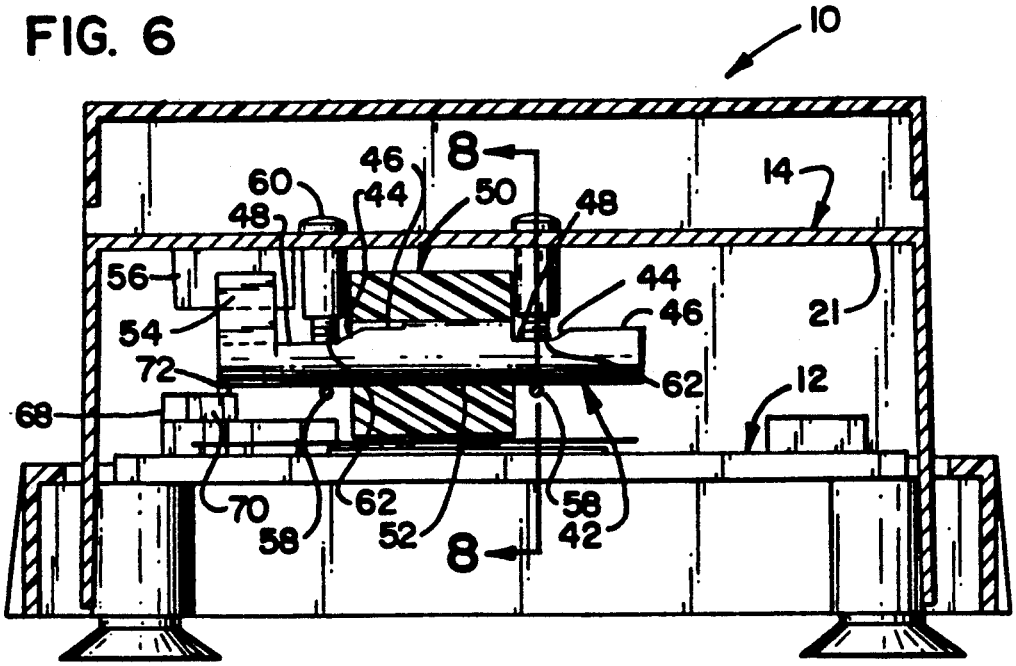
FIG. 6 is a front elevational view similar to FIG. 5, showing the print roller in a raised state.

At the completion of an imprinting stroke, the print roller 50 is raised so that a second, unwanted impression will not occur on the return stroke. As may be seen in FIG. 6, raising of the print roller 50 is accomplished in part by the interaction of the cam follower 72 of the print roller axle 42 with a first cam surface 68. As the cam follower 72 encounters the first cam surface 68, the print roller axle 42 is forced to slide laterally in the direction shown, thereby displacing the ends 62 of the adjusting screws 60 from contact with the upper bearing surfaces 46 to a position over the lower bearing surfaces 48. Spring biasing means 58 bias the print roller axle 42 upward and into contact with the adjusting screw ends 62, thus raising the print roller 50 above the transaction form 66. A return stroke of the printer carriage 14 may now be made without creating a second impression on the transaction form 66.

At the end of the return stroke, print roller 50 is lowered into position for performing another imprint stroke. As shown in FIG. 5, lowering of the print roller 50 is accomplished in part by the interaction of the cam follower 72 of the print roller axle 42 with a second cam surface 70. As the cam follower 72 encounters the second cam surface 70, the print roller axle 42 is forced to slide laterally in the direction shown, thereby displacing the ends 62 of the adjusting screws 60 off the lower bearing surfaces 48, up inclined ramps 44, and onto the upper bearing surfaces 46. Spring biasing means 58 bias the print roller axle 42 upward, thus ensuring continuous contact with the screw ends 62 and proper positioning of the print roller 50 relative to the surface of the base plate 12.

Note that as the print roller axle 42 is forced laterally by the first and second cam surfaces 68, 70, the axle 42 slides through the axial bore 52 of the print roller 50. The proper alignment of the print roller 50 over the transaction form 66 is maintained by the screws 60 being situated on either side of the print roller 50.

It is to be understood that even though numerous characteristics and advantages of the present invention have been set forth in the foregoing descriptions, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An imprinter apparatus for imprinting data from a source member onto a recording document, said imprinter apparatus comprising:

a base plate;

a print carriage; and attachment means for attaching said print carriage to said base plate such that said print carriage is free to move in a linear direction with respect to said base plate, said attachment means including channel means formed in said base plate, first rolling means and second rolling means cooperating with said channel means for guiding said print carriage with respect to said base plate, first mounting means for rotatably mounting said first rolling means onto said print carriage such that said first rolling means is prevented from moving laterally relative to said print carriage, second mounting means for rotatably mounting said second rolling means onto said print carriage such that said second rolling means is allowed to move laterally relative to said print carriage, and biasing means for retaining said first rolling means and said second rolling means within said channel means such that said print carriage is prevented from moving vertically, laterally, and rotationally with respect to said base plate.

2. An imprinter apparatus in accordance with claim 1, wherein said channel means includes two parallel channels formed along the length of a surface of said base plate.

3. An imprinter apparatus in accordance with claim 2, wherein said channels are formed having a V-shaped cross-sectional profile, and said first rolling means and said second rolling means include rollers having circumferential edges which conform to the profile of said channels.

4. An imprinter apparatus in accordance with claim 2, wherein said channels are formed in a top surface of said base plate.

5. An imprinter apparatus in accordance with claim 1, wherein said first rolling means and said second rolling means include rollers made of plastic.

6. An imprinter apparatus in accordance with claim 1, wherein said first mounting means includes a first roller pin permanently mounted at a first end to a first inner side surface of said print carriage, said first roller pin having a flange formed in a second end for preventing lateral movement of said first roller means thereon, and wherein said second mounting means includes a second roller pin permanently mounted at a first end to a second inner side surface of said print carriage, said second roller pin being formed to allow lateral movement of said second roller means thereon.

7. An imprinter apparatus in accordance with claim 1, wherein said biasing means for retaining said first rolling means and said second rolling means within said channel means includes pressure rollers rotatably mounted to inner side surfaces of said print carriage, said pressure rollers bearing against a surface of said base plate opposite said first rolling means and said second rolling means.

8. An imprinter apparatus for imprinting data from a source member onto a recording document, said imprinter apparatus comprising:

a base plate;

a print carriage for transporting a print roller over said base plate; and means for raising and lowering said print roller at predetermined intervals through an imprinting stroke, comprising:

a molded print roller axle, said molded print roller axle being axially inserted through said print roller such that said print roller is free to rotate upon contact with the recording document during imprinting, said molded print roller axle having an inclined planar surface formed thereon, said inclined planar surface having an upper end and a lower end;

contact means for bearing against said inclined planar surface such that said print roller is in a lowered position when said contact means contacts said inclined planar surface upper end and said print roller is in a raised position when said contact means contacts said inclined planar surface lower end;

means for biasing said molded print roller axle against said contact means;

camming means for reciprocally sliding said molded print roller axle axially through said print roller such that said contact means is caused to contact either said inclined planar surface upper end or said inclined planar surface lower end; and means for restraining said molded print roller axle against axial rotation.

9. An imprinter apparatus in accordance with claim 8, wherein said molded print roller axle is made of a plastic material.

10. An imprinter apparatus in accordance with claim 8, wherein said inclined planar surface of said molded print roller axle comprises an upper planar surface, a lower planar surface, and an inclined planar surface forming a ramp therebetween.

11. An imprinter apparatus in accordance with claim 8 wherein said contact means includes means for adjusting the downward force of said print roller against said base plate.

12. An imprinter apparatus in accordance with claim 11 wherein said adjusting means includes a plurality of screws threaded through an inner top surface of said print carriage, said screws having flat ends which bear against said planar surfaces of said molded print roller axle, said screws having heads adapted for manually advancing or withdrawing said screws.

13. An imprinter apparatus in accordance with claim 8 wherein said biasing means includes a spring attached at one end to an inner surface of said print carriage, a second end of said spring bearing against said molded print roller axle such that said axle is urged against said contact means.

14. An imprinter apparatus in accordance with claim 8 wherein said camming means includes a camming surface mounted at one end of said base plate for interacting with an end of said molded print roller axle at the completion of an imprinting stroke such that said print roller is caused to raise out of contact with the recording document, and a camming surface mounted at a second end of said base plate for interacting with an end of said molded print roller axle at the completion of a return stroke such that said print roller is caused to lower into contact with the recording document.

15. A method of attaching a print carriage to a base plate of an imprinter apparatus such that said print carriage is free to move in a linear direction with respect to said base plate, comprising the steps of:

forming parallel channels along the length of a surface of said base plate;

rotatably mounting first rolling means to an inner side surface of said print carriage such that said first rolling means is prevented from moving laterally relative to said inner side surface of said print carriage;

aligning said first rolling means within one of said channels;

rotatably mounting second rolling means to an inner side surface of said print carriage such that said second rolling means is allowed to move laterally relative to said inner side surface of said print carriage;

aligning said second rolling means within another one of said channels;

retaining said first rolling means and said second rolling means within said channels such that said print carriage is prevented from moving vertically, laterally, and rotationally with respect to said base plate.

16. An imprinter apparatus for imprinting data from a source member onto a recording document, said imprinter apparatus comprising:

a base plate;

a print carriage for transporting a print roller over said base plate; and means for raising and lowering said print roller at predetermined intervals through an imprinting stroke, comprising:

a molded print roller axle, said molded print roller axle being axially inserted through said print roller such that said print roller is free to rotate upon contact with the recording document during imprinting, said molded print roller axle having an inclined planar surface formed thereon, said inclined planar surface having an upper end and a lower end;

contact means for bearing against said inclined planar surface such that said print roller is in a lowered position when said contact means contacts said inclined planar surface upper end and said print roller is in a raised position when said contact means contacts said inclined planar surface lower end;

means for biasing said molded print roller axle against said contact means;

camming means for reciprocally sliding said molded print roller axle axially through said print roller such that said contact means is caused to contact either said inclined planar surface upper end or said inclined planar surface lower end; and means for restraining said molded print roller axle against axial rotation including a slot formed by flanges extending from an end of said molded print roller axle, a fin projecting from an inner surface of said print carriage, said slot engaging said fin so as to prevent rotation of said molded print roller axle.

* * * * *